United States Patent [19]

Bellusci

[11] Patent Number: 4,934,957

[45] Date of Patent: Jun. 19, 1990

[54] AUTOMOTIVE BATTERY TERMINAL CLAMP FOR A BATTERY JUMPER CABLE

[76] Inventor: Albert V. Bellusci, 4150 Edgewood Dr., Missoula, Mont. 59802

[21] Appl. No.: 394,002

[22] Filed: Aug. 15, 1989

[51] Int. Cl.[5] ..... H01R 11/00

[52] U.S. Cl. ..... 439/504; 439/829

[58] Field of Search ..... 439/502–506, 439/829

[56] References Cited

U.S. PATENT DOCUMENTS

| | | | |
|---|---|---|---|
| 3,267,452 | 8/1966 | Wolf | 439/504 |
| 3,456,181 | 7/1969 | Godshalk | 439/504 |
| 4,721,479 | 1/1986 | Shuman | 439/503 |

*Primary Examiner*—Joseph H. McGlynn

*Attorney, Agent, or Firm*—Wells, St. John & Roberts

[57] ABSTRACT

A clamp for battery jumper cables includes a pair of pivoted terminal gripping members with a switch and linkage arrangement connected between a conductive jaw and the conductive jumper cable to facilitate electrical connection and disconnection of the jaw and jumper cable in a controlled, spark-free manner. The linkage includes first and second lever sections pivotally connected to one of the handle sections of the terminal clamp. A first lever is operated as the clamp is grasped in the user's hand. This lever causes the over-center linkage to shift to a first over-center position, opening the switch and breaking electrical contact between the clamp and jumper cable before the jaws are forcibly opened. The over-center linkage serves to hold the switch in an open, nonconductive state even though the clamp handles are released to secure the jaws against the terminal. A second lever must be consciously pressed before the switch is allowed to move to a closed condition and electrically connect the clamp and jumper cable. The second lever is pressed to shift the over-center mechanism back over-center bringing first and second contact surfaces of the switch together in flush conductive engagement. Subsequent grasping of the clamp will cause the switch to be opened before the clamp is removed from the terminal.

18 Claims, 6 Drawing Sheets

AUTOMOTIVE BATTERY TERMINAL CLAMP FOR A BATTERY JUMPER CABLE

TECHNICAL FIELD

The present invention relates to automotive battery terminal jumper.

BACKGROUND OF THE INVENTION

Automotive battery "jumper cables" are well known for use in electrically connecting a discharged battery to a charged battery of another vehicle. This is done to derive sufficient current from the charged battery to start the vehicle having the discharged battery. Conventional "jumper cables" include a pair of electrically conductive cables, each having a pair of hand operated terminal clamps at opposed ends. The terminal clamps are typically in the form of a spring pincer with jaws at one end and handles at the other. The spring urges the jaws toward a closed position. The jaws may be forcibly separated by gripping the handles in the hand and pivoting them toward one another. The handles may be released to enable the jaws to close on the terminal of a battery. At least portions of the jaws are electrically connected to the associated conductive cable.

It is a hazardous process to connect the terminals of batteries, especially when one of the batteries is in a discharged condition. The rush of current from the charged battery to the discharged battery will often result in sparks as initial contact is made. The hazard is not necessarily from the sparks but more from the potential of igniting explosive gases that may be present about the batteries. Serious injury can occur should the explosive gases be ignited and the battery burst.

The above problem has led to development of devices for suppressing, isolating or eliminating such sparking as terminal clamps are connected to electrical power terminals. However, many such attempts result in complicated and expensive apparatus that are difficult to produce and cost prohibitive to the average consumer.

It is therefore an object of the present invention to provide a device that is relatively simple, inexpensive, easy to operate, and has the capability of eliminating an electrical spark when cable clamps are connected across electrical power terminals.

A further object is to provide such a safety device that is safe in use, being relatively automatic to open a switch and prevent current from flowing to the associated cable as the clamp handle sections are gripped, and by requiring a separate, positive action by the user to complete the circuit once the clamp is secured to the associated terminal.

BRIEF DESCRIPTION OF THE DRAWINGS

A preferred form of the present invention is illustrated in the accompanying drawings, in which:

FIG. 4 is a view similar to FIG. 3 only showing the switch and linkage assemblies in an opened, disconnected condition;

DETAILED DESCRIPTION OF A PREFERRED EMBODIMENT

Figure 1:
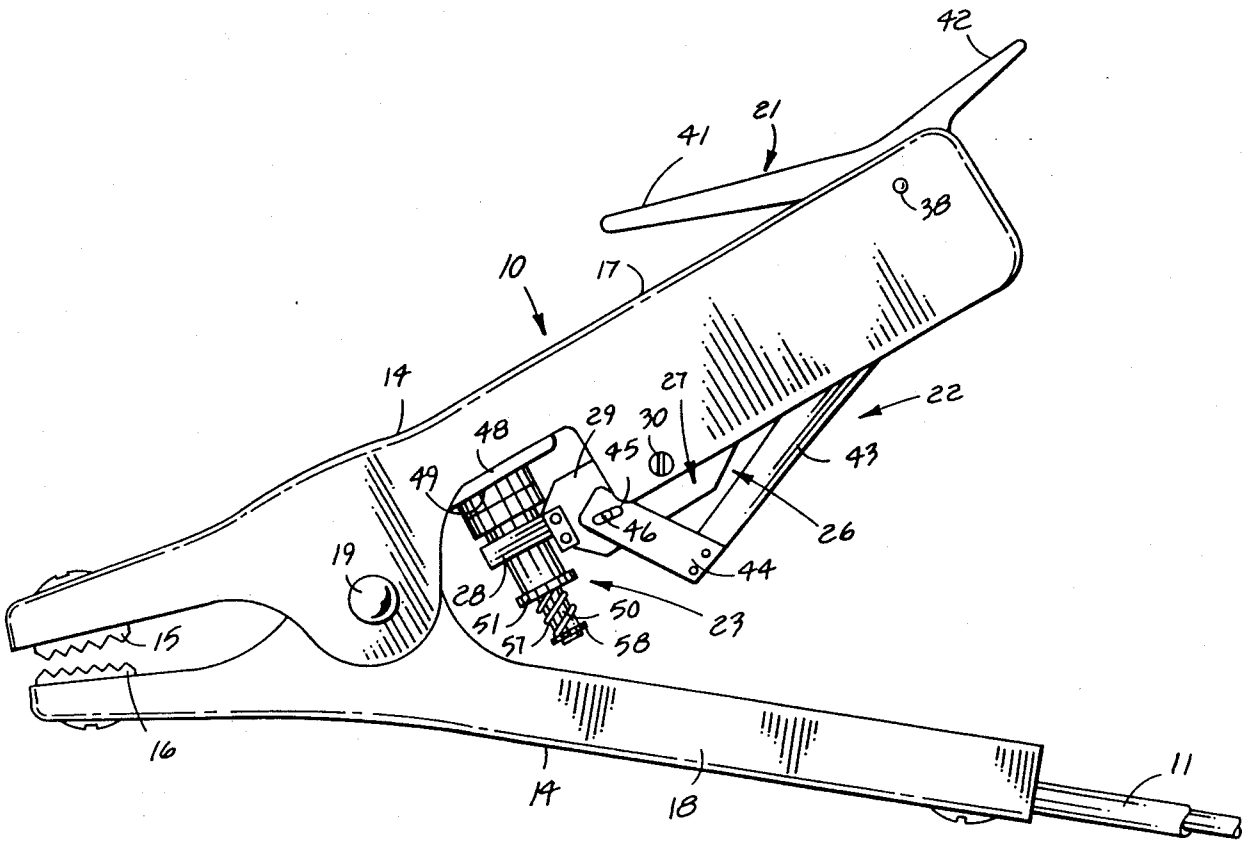
FIG. 1 is a side elevation view of a preferred clamp assembly illustrating features of the present invention with a section of conductive jumper cable attached thereto.
Figure 2:
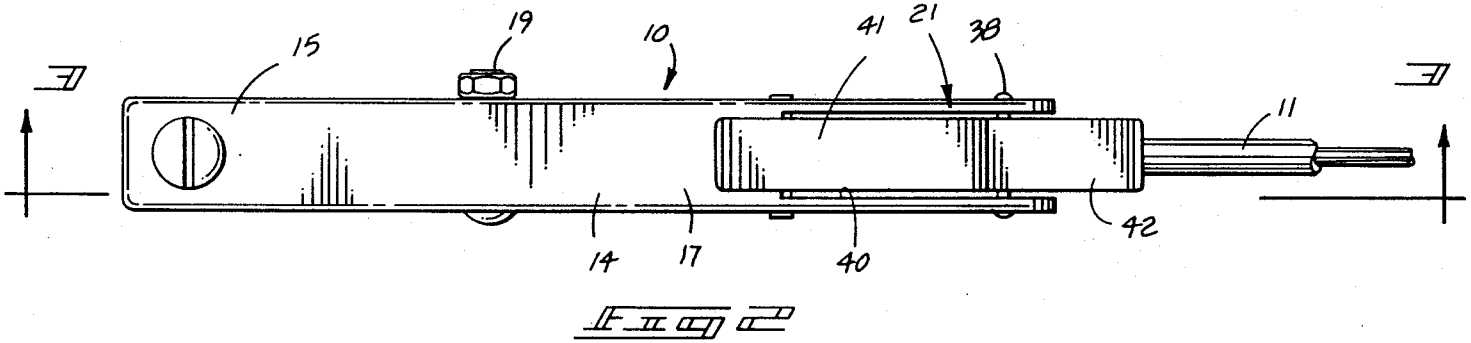
FIG. 2 is a top plan view thereof.

The following disclosure of the invention is submitted in furtherance with the constitutional purpose of the Patent Laws "to promote the progress of science and useful arts" (Article 1, Section 8).

The present invention is provided to reduce or eliminate the chance of an electric spark occurring when electrically jumper cables are connected across automotive battery power terminals. By eliminating sparks, the possibility of igniting explosive gases that may be present at the terminal is greatly reduced or eliminated. This objective is accomplished in the present device by utilizing a switch and actuator assembly within the grip of a terminal clamp.

In the drawings, the present safety terminal clamp is generally designated by the reference numeral 10. The clamp 10 is utilized for connecting an electrically conductive battery jumper cable 11 to a battery power terminal 12 (FIG. 4).

A terminal clamp 10 may be provided at either end of the cable 11. In a jumper cable set, there will be two jumper cables 11 provided and four terminal clamps 10, one at each end of the two cables. The cables may be separate or joined as conventional conductive jumper cables (not shown) that are well known in the art.

Each terminal clamp 10 includes a pair of battery terminal gripping members 14. A pair of jaws, 15, 16 are situated at one end of the terminal gripping members 14. At least one of the jaws 15 is conductive. Handle sections 17, 18 extend rearwardly from the jaw sections 15, 16 respectively. One handle section 17 is connected to the jaw 15 and the other handle section 18 is connected to jaw 16.

A pivot pin 19 pivotally joins the terminal gripping members 14 between the handle sections 17, 18 and the jaws 15, 16. The pivot pin 19 joins the gripping members 14 for pivotal movement relative to one another about an axis between the jaw and handle sections.

Biasing means in the form of a torsion spring 20 (FIGS. 3, 4) is provided between the terminal gripping members to normally urge the jaws 15, 16 toward one another and the handle sections 17, 18 away from one another. The spring 20 will yield to gripping of the handle sections in a user's hand, forcing the handle sections 17, 18 toward one another. In response, the jaw sections 15, 16 will separate to accommodate a terminal 12 therebetween. Then, when the gripping is relaxed, the jaws will forcibly close, by action of the spring against the terminal.

Important aspects of the present invention are an actuator means 21 and a switch 23 by which electrical connection between the conductive jaw section 15 and the battery cable 11 is opened and closed.

In general, the switch 23 is mounted to the gripping members 14 and is electrically connected to the conductive jaw section 15. It is adapted for connection to the conductive cable 12. The switch 23 is provided for selective opening and closing to make and break electrical contact between the conductive jaw section 15 and battery cable 11.

In general, the actuator means 21 is also mounted to the pair of gripping members and is connected to the switch 23 for (a) opening the switch to break electrical contact between the conductive jaw section 15 and battery cable 11 as the handle sections are gripped and before the jaw sections 15, 16 move away from one another; (b) for holding the switch open following release of the handle sections (FIG. 4); and (c) selective operation to close the switch.

Details of a preferred form of switch 23 and actuator means 21 for accomplishing the above functions are more fully described below.

The actuator means 21 includes a linkage 22 connected to the switch 23. The linkage 22 is selectively operable to move the switch between open and closed conditions.

Figure 3:
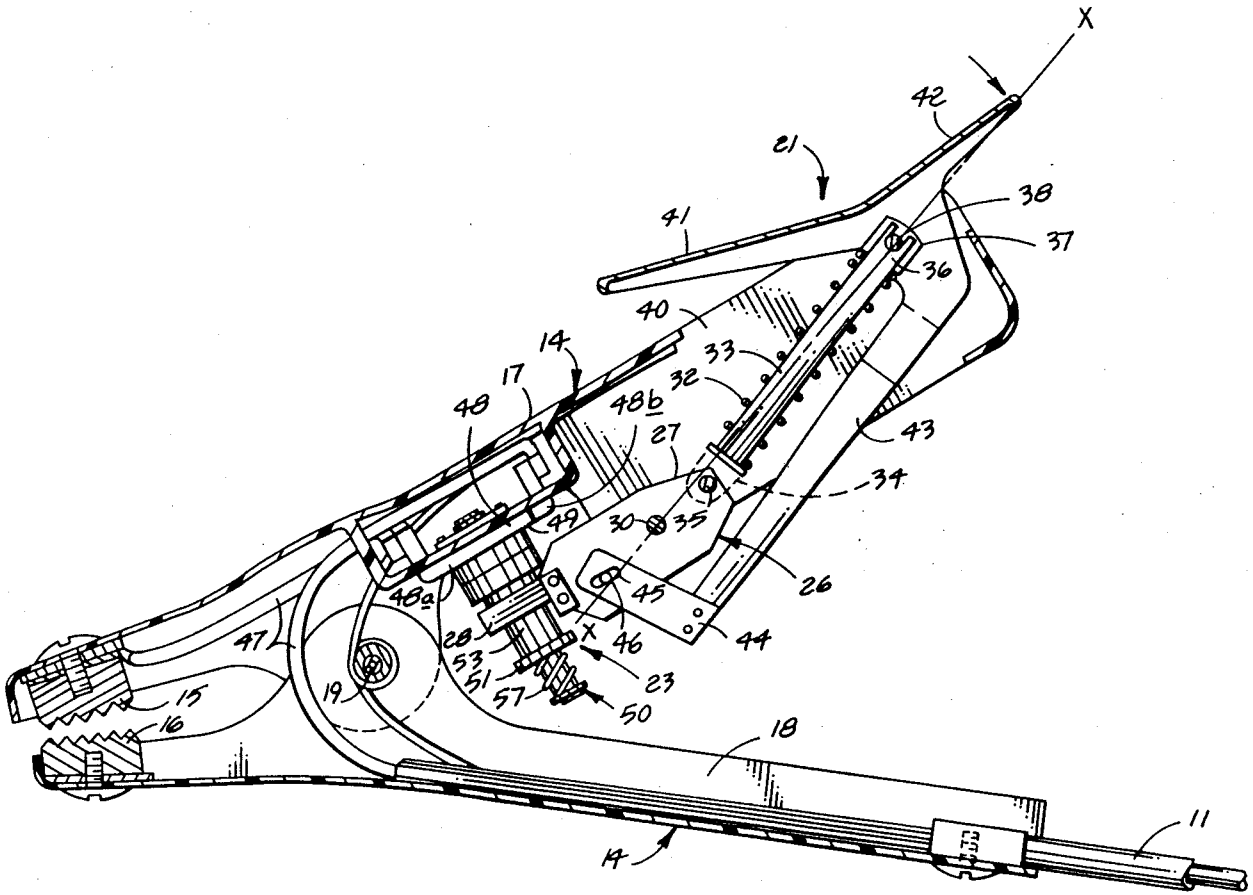
FIG. 3 is a sectional view taken substantially along line 3—3 in FIG. 2 and exemplifying a switch and linkage mechanism in a closed orientation.
Figure 3:
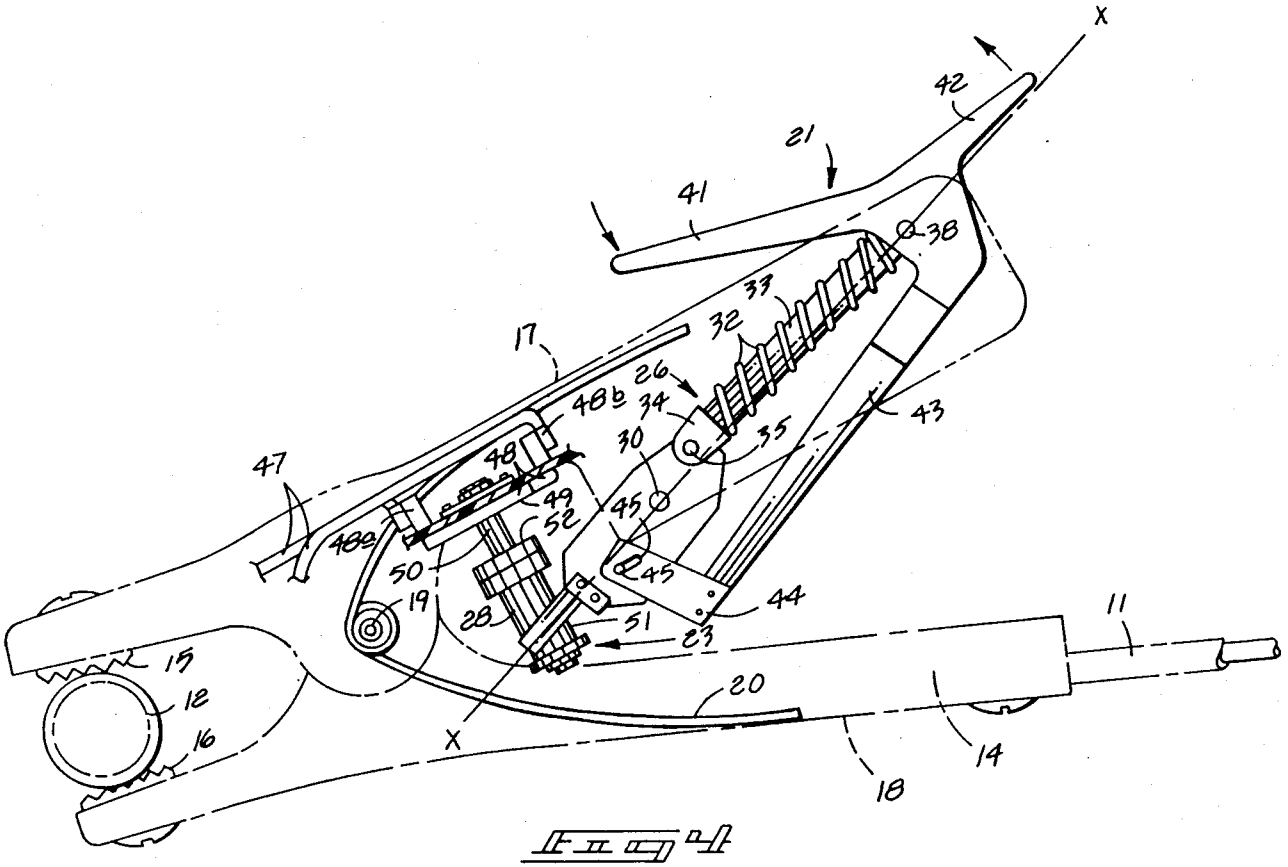
Figure 5:
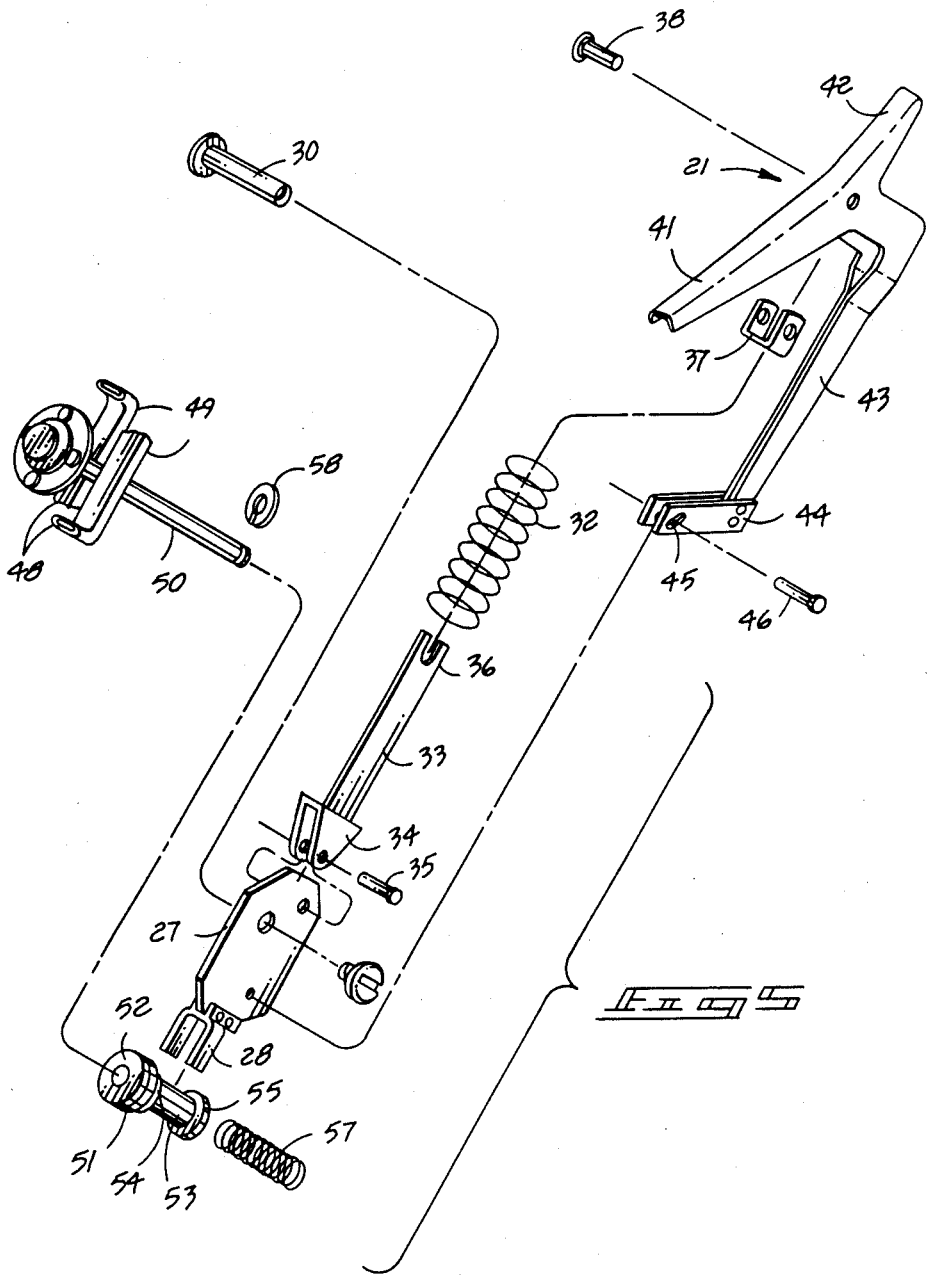
FIG. 5 is an exploded perspective view of the switching and linkage arrangements.

More specifically, the preferred form of linkage is an over-center linkage assembly 26 as shown in specific detail by FIGS. 3 through 5. It includes a yoke 27 having a bifurcated end 28 for sliding engagement with the switch 23. The bifurcated end 28 extends forwardly from a yoke plate 29. Plate 29 is mounted by a pivot pin 30, preferably to the one handle section 17. The plate 29 will pivot about the axis of pin 30 in a rocking motion, thereby selectively moving the bifurcated end 28 in an arcuate, axial motion relative to the switch 23.

The over-center linkage 26 also includes an over center-spring 32. The spring 32 is preferably a coiled compression spring, mounted over an elongated guide rod 33. One end of the spring engages a guide rod clevis end 34 that is pivotally mounted to the plate 29. A pin 35 extends through the clevis 34 and plate 29 at an end of the plate 29 opposite the bifurcated end 28.

An end of the guide rod 33 opposite the clevis end 34 includes a slot 36. A slide clevis 37 is slidably received over the slotted end 36 to engage the opposite end of the over-center spring 32. A lever pivot pin 38 extends through the slide clevis 37 and is received within the slotted guide rod end 36.

The spring is selectively compressed between the clevis end 34 and the slide clevis 37. The guide rod 33 and its clevis end 34 are therefore continuously urged by the spring away from the lever pivot pin 38. The pin 38 pivotally anchors the guide rod to the associated handle section. The rod 33, however, is allowed limited motion along its length by means of the slotted end 36. Thus, the spring acting against the slide clevis 37 and clevis end 34 will urge pivotal motion of the yoke 27 about its pivot pin 30 except at a dead center position at which the pins 30, 35, and 38 are aligned with one another. The dead center alignment of the pins 30, 35, and 38 is identified in FIGS. 3 and 4 by a center-line X—X.

Compressive forces of the spring will urge the linkage to pivot either to a first over-center position wherein the switch 23 is open (FIG. 4), or a second over-center position wherein the switch 23 is closed (FIG. 3). In the first over-center position, the pin 35 is positioned above the dead center pin positions. In the second over-center position the pin 35 is situated below the dead center pin positions. Once past the dead center position, the spring continuously urges the bifurcated yoke end 28 either downwardly in the first over-center position shown in FIG. 4 or upwardly in the second over-center position in FIG. 3.

First and second levers 41, 42 are provided to selectively operate the linkage to shift between the over-center positions described above and thereby operate the switch 23 to open and close. It is advantageous that the first and second lever sections 41, 42 be integral, and that the first lever section 41 extend forwardly from the axis of pivot pin 38 and that the second lever section 42 extend rearwardly thereof.

The first lever section 41 projects forwardly over the adjacent handle section of the gripping members a first radial distance from the axis of the pivot pin 38. The rearward second lever section 42 will project rearwardly, preferably clear of the adjacent handle section by a second radial distance from the axis of the pivot pin 38. The second radial distance is preferably less than the first radial distance in order to effect a difference in mechanical advantage between the levers, with the second lever being shorter and more difficult to operate than the longer first lever section 41. This feature, along with rearward projection of the second lever section 42 aids to prevent its unintentional gripping and operation.

It is preferred that the two lever sections 41, 42 be angularly oriented to one another as shown so as one section is pivoted down toward the adjacent handle section, the other lever section will simultaneously pivot upwardly. One of the lever sections is therefore always in an upwardly oriented position, ready for operation.

Both lever sections are movably received within an open slot 40 formed in the associated handle section of the terminal gripping members 14. Both lever sections 41, 42 are mounted to the lever pivot pin 38 for rocking, pivotal motion. Thus, a hand gripping the handle sections 17, 18 will first engage and pivot the first lever section 41 downwardly toward the adjacent handle section. The second lever section will automatically and simultaneously pivot upward.

The above action will occur before the handle sections will begin to pivot about the handle pivot pin 19 to open the jaws sections 15, 16. This is due, in part, to the orientation of the first lever 41 as shown above the outwardly exposed gripping surfaces of the adjacent handle section. The user's hand will naturally first grasp the first lever 41 before both handle sections are effectively gripped. The gripping force is therefore first transmitted through the first lever 41 with the lever pivot pin 38 acting as a fulcrum.

An arm 43 extends forwardly from the first and second lever sections 41, 42. Arm 43 extends to an upturned end 44 that is bifurcated as shown in FIG. 5. The branches of the upturned end 43 receive the plate 29 therebetween. A lever yoke pin 46 extends through the plate 29 and is received within a lost motion slot 45 of the upturned end 44.

The lever yoke pin 46 is situated between the bifurcated yoke end 28 and the pivot pin 30. The geometry with the various pins is such such downward, gripping action of a hand against the first lever 41 will cause the arm 43 to swing downwardly, pulling the bifurcated end 28 of the yoke downwardly and snapping the over-center linkage to the downward position shown in FIG. 4. Conversely, downward force applied against the rearwardly extending second lever 42 will cause the arm 43 to swing upwardly. The upwardly swinging arm will cause corresponding pivotal motion of the yoke 27 and its bifurcated end 28 upwardly, causing the over-center linkage to snap to the closed operative position shown in FIG. 3.

It is emphasized that forces applied to operate the second lever section 42 must be focused near the outward end of the second lever 42, rearwardly beyond the adjacent handle section of the terminal gripping members. Thus, the second lever 42 may not be actuated to swing downwardly as a result of ordinary gripping action of the two handle sections 17, 18. Rather, a concerted, conscious effort is normally required to press the second lever section 42 downwardly.

Figure 6:
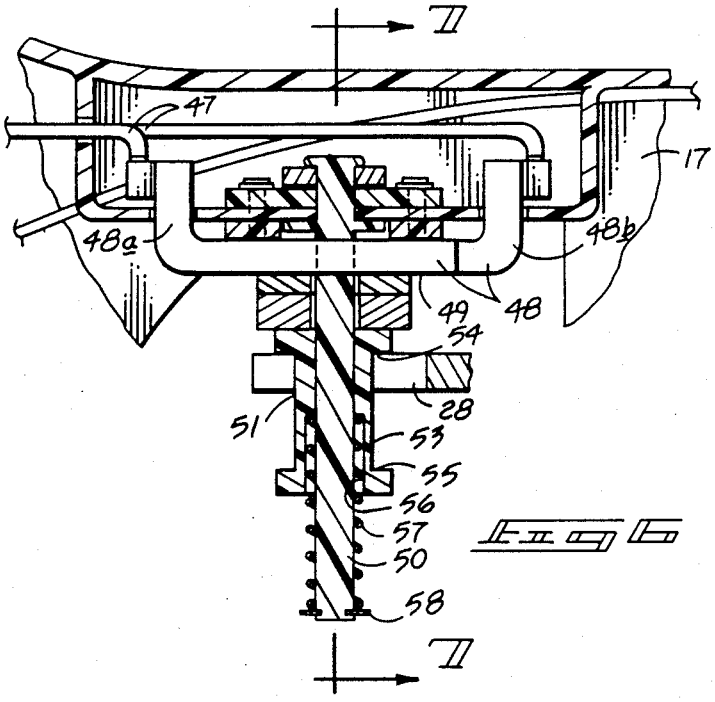
FIG. 6 is an enlarged fragmentary sectional view of preferred switching components.
Figure 7:
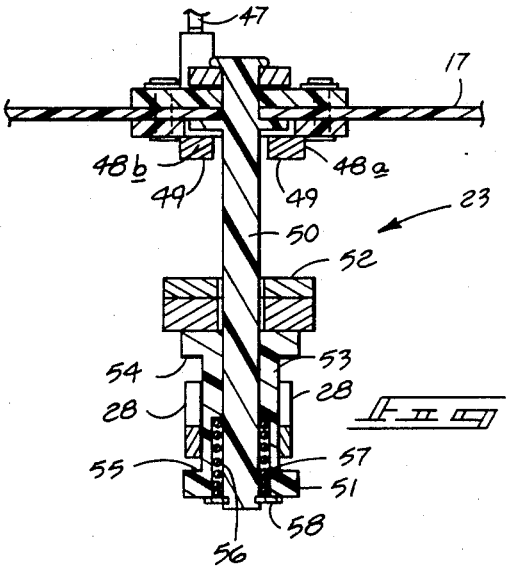
FIG. 7 is a sectional view taken substantially along line 7—7 in FIG. 6 only showing the switch in an open, disconnect position.

The switch 23 is shown in substantial detail by FIGS. 6 and 7. The preferred switch is comprised of first contacts 48 and second contacts 51 that move relative to one another between closed and open positions. The closed position is illustrated in detail by FIG. 6 and generally in FIG. 3 while the open position is shown in detail by FIG. 7 and in general by FIG. 4.

Referring specifically to FIGS. 6 and 7, it will be seen that the first contacts 48 are comprised of a pair of electrically separate contact plates 48*a*, 48*b*. A pair of wire leads 47 are provided. One lead 47 connects one of the separate plates 48*a* to the conductive jaw 15. The other lead connects the remaining contact plate 48*b* to the cable 11.

The first contacts 48 include areal contact surfaces 49. It is advantageous, for purposes of simplicity, that the areal surfaces 49 be flat and coplanar.

It is also advantageous that the surfaces 49 be substantially perpendicular to the long axis of a headed guide pin 50. The pin 50 is secured to the adjacent handle section and projects between the first contact plates 48*a*, 48*b*. The pin is nonconductive, therefore acting as an insulator between the two plates 48*a*, 48*b*.

The guide pin 50 also functions to mount the second contact 51 for slidable substantially translational movement toward and away from the contact plates 48*a*, 48*b*. The path of movement of the second contact is defined by the pin to be substantially perpendicular to the planar surfaces 49 of the plates 48*a*, 48*b*.

Second contact 51 includes a conductive areal contact surface 52 for flush, bridging electrical engagement with the conductive areal surfaces 49 of the first contacts. The surface 52 is perpendicular to the pin 50 and parallel to the planar surfaces of the plates 48*a*, 48*b*.

The second contact 51 also includes a substantially cylindrical recessed surface 53 bounded axially by a top shoulder 54 and a bottom shoulder 55. The recessed surface 53 receives the branches of the bifurcated yoke end 28. Shoulders 54 and 55 are axially engaged by the bifurcated yoke end 28 in the open and closed switch positions shown respectively by FIGS. 4, 7; and 3, 6.

The second contact 51 further includes a bore 56 for receiving a spring 57. The spring 57 is a compression spring extending between a shoulder at one end of the bore 56 and a spring clip retainer 58 at the end of guide pin 50. The spring 57 acts between the second contact 51 and the relatively stationary guide pin 50 to normally urge the second contact toward a closed condition wherein the areal surfaces 49 and 52 are intimately engaged.

Thus, but for operation of the over-center linkage, the switch 23 will normally be closed. This provision is made to prevent undesired movement of the second contact during motion of the bifurcated yoke end 28 between the closed position of FIG. 3 and the open position of FIG. 4. The switch will therefore remain closed as the first lever section is initially pressed. As this happens, the bifurcated yoke end is shifted axially along the recessed surface 53 to the position where bottom shoulder 55 is engaged. Further pressing of the first lever section will then cause the linkage to snap to the, over-center position shown in FIG. 4. As the linkage snaps over-center, the second contact 51 will be snapped open.

Likewise, the second contact 51 will be allowed to move axially along the guide pin 50 responsive to the spring 57 as the second lever section 42 is activated to shift the over-center linkage to the closed, FIG. 3 position. Thus, the contacts are controlled to open and close in a positive, controlled manner.

Operation of the present safety terminal clamp will now be described in relation to the procedures normally used for connecting one battery terminal to another. The assumption is, to begin with, that one of the present automotive battery terminal clamps will be provided at each end of a jumper cable 11. While this is not absolutely necessary, it is desirable for maximum safety. Operation of each clamp will be identical to the others.

Operation to connect the terminals, say of one battery to another, using the present invention may be initiated as with ordinary, conventional jumper cables and clamps. The action by the user in grasping the handle sections 17, 18 will automatically result in the hand engaging and operating the first lever section 41. This is due to the orientation of the lever section 41 overlying the adjacent handle section. Continued gripping action will cause the first lever section to pivot toward the handle and shift the over-center linkage downwardly from the FIG. 3 position toward the FIG. 4 position. Thus, if the switch is not already open, the linkage will snap the switch 23 to the open position. It is noted that the open position shown in FIG. 4 will be maintained by the over-center linkage regardless of whether the handles section are gripped or released.

Further positive action is required before the switch may be closed. Thus, continued gripping force may be applied by he hand against the handle sections to cause the jaws to separate following action of the lever section 41 and over-center linkage to open switch 23. Such continued gripping action will cause the jaw sections 15 and 16 to separate to accommodate the terminal 12.

The handle sections can then be released simply by releasing the gripping force of the hand against the handle sections. The result is that the torsion spring 20 will urge the jaws back toward this closed (FIG. 3) position. The terminal, however, prevents complete closure of the jaws which thereby clamp themselves securely to the terminal.

As this is being done, the switch 23 will remain in the open condition due to the tendency for the over-center linkage to continue urging the second switch contact 51 away from the first contacts as shown in FIGS. 4 and 7.

Until acted upon otherwise, the over-center linkage will remain in the "open" state and hold the second contact apart from the first contacts. Thus, no current may flow to or from the engaged terminal until further positive action is taken. No spark can therefore result.

The switch is closed by pressing the second lever 42 downwardly, causing the yoke to pivot upwardly and allowing the compression spring 57 to close the switch 23. This is done substantially in a snap action as the shorter radius of the first lever, though requiring additional force to operate also operates in a much faster action than the first lever section 41. Thus, motion of the switch to close is a relatively quick, snapping action as the spring returns the second contact into flush engagement with the first contacts. The yoke, during this time, swings to move the bifurcated end 28 upwardly, engaging the top shoulder 54, to positively hold the switch closed.

The switch will remain in the closed position until the clamp handles are once more gripped. This action is a repetition of the switch opening and subsequent jaw opening operation described above. Thus, conductivity will be maintained only so long as the switches at opposite ends of the cables are held closed. A user intending to disconnect the clamps from the terminals will automatically grasp the upwardly pivoted first lever sections and, by gripping the handles, will cause the switches to open, breaking the circuit quickly and without spark before the jaws 15, 16 separate from contact with the battery terminals 12.

It may be seen from the above that the conditions often resulting in spark when the jaw sections initially touch the terminals 12 are eliminated. Further, the process involved in completing electrical connection between the jaws and cable is accomplished in a controlled, safe manner. The areal surfaces of the switch move translationally such that the areal surfaces are, at one instant, intimately engaged for conducting current, and at another instant, separated. Sparks are therefore avoided by the quick connection and disconnection of relatively large conductive surface areas.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An automotive battery terminal clamp for a battery jumper cable, comprising:

a pair of terminal gripping members each including a jaw section and a handle section, at least one of the jaw sections being electrically conductive;

a pivot pin joining the gripping members together for pivotal movement relative to one another about an axis between the jaw and handle sections thereof;

biasing means on the gripping members for normally urging the handle sections apart and the jaw sections together about the axis so that a hand forcibly gripping the handles against resistance of the biasing means may pivot the handles toward one another and thereby cause corresponding pivotal motion of the jaw sections apart from one another and so that relaxing of the hand grip will allow the jaw sections to close responsive to the biasing means;

a switch mounted to the gripping members and electrically connected to the conductive jaw section and adapted for connection to the jumper cable, for selectively opening and closing to make and break electrical contact between the conductive jaw section and jumper cable; and an actuator means on the pair of gripping members and connected to the switch for (a) opening the switch to break electrical contact between the conductive jaw section and cable responsive to said gripping, (b) holding the switch open following release of the handle sections, and for (c) selective operation to close the switch.

2. An automotive battery terminal clamp for a battery jumper cable as claimed by claim 1 wherein the actuator means is comprised of:

a linkage connected to the switch; and a hand engagable first lever on one of the handle sections for operating the linkage to open the switch when the handle sections are gripped.

3. An automotive battery terminal clamp for a battery jumper cable as claimed by claim 2 wherein the actuator means is further comprised of:

an second lever connected to the linkage for operating the switch to close.

4. An automotive battery terminal clamp for a battery jumper cable as claimed by claim 3 wherein the second lever is mounted to the one handle section.

5. An automotive battery terminal clamp for a battery jumper cable as claimed by claim 2 wherein the actuator means is further comprised of:

a hand engagable first lever pivotally mounted to one of the handle sections for operating the linkage to open the switch when the handle sections are gripped;

wherein the linkage is an over-center linkage connecting the first lever to the switch, for shifting to a first over-center position responsive to pivotal movement of the first lever to open the switch when the handle sections are gripped and for remaining in the first over-center position, holding the switch open after the grip on the handle sections is released.

6. An automotive battery terminal clamp for a battery jumper cable as claimed by claim 5 wherein the actuator means is further comprised of:

a hand engagable second lever on the one handle section and connected to the over-center linkage for operating the over-center linkage to (a) shift to a second over center position to close the switch and to (b) hold the switch closed until the first lever is operated to shift the over-center linkage back to the first over-center position.

7. An automotive battery terminal clamp for a battery jumper cable as claimed by claim 6 wherein the first and second levers are integral.

8. An automotive battery terminal clamp for a battery jumper cable as claimed by claim 1 wherein the actuator means is comprised of:

a first lever section projecting over a portion of one of the handle section and pivotally mounted to the one handle section;

a second lever section projection opposite the first lever section;

the lever sections being integral and angularly oriented to one another such that when one lever section is pressed down toward the one handle section, the other lever section is pivoted upwardly from the one handle section;

a linkage connected between the lever sections and the switch, to open the switch when the first lever section is pressed toward the one handle section and to close the switch when the second lever section is pressed toward the one handle section.

9. An automotive battery terminal clamp for a battery jumper cable as claimed by claim 8, wherein the linkage is an over-center linkage containing the first and second lever sections to the switch, responsive to pivotal movement of the first lever section to (a) shift to a first over-center position and open the switch when the handle sections are gripped and to (b) remain in the first over-center position, holding the switch open after the grip on the handles is released; and wherein the over-center linkage is also responsive to pivotal movement of the second lever section to shift to a second over-center position to close the switch when the second lever section is pressed down toward the one handle section.

10. An automotive battery terminal clamp for a battery jumper cable as claimed by claim 1 wherein the switch is comprised of:

first contacts adapted to be mounted to the electrically conductive cable and the electrically conductive jaw section and including areal conductive contact surfaces electrically insulated from one another;

a second contact mounted to the actuator means and having a conductive areal contact surface complimentary to the contact surfaces of the first contacts for flush bridging engagement therewith;

wherein the actuator means is operable to (a) move the second contact into flush engagement with the contact surfaces of the first contacts and thereby electrically connect the jumper cable and conductive jaw section and to (b) disengage the contact surfaces of the first contacts and thereby disconnect the jumper cable and conductive jaw section.

11. An automotive battery terminal clamp for a battery jumper cable as claimed by claim 10 further comprising biasing means for urging the second contact of the switch toward flush conductive contact with the first contacts.

12. An automotive battery terminal clamp for a battery jumper cable as claimed by claim 10 wherein the actuator means is comprised of:

a linkage connected between one of the handle sections and the second contact of the switch; and a hand engagable first lever on one of the handle sections for operating the linkage responsive to gripping of the handle sections to disengage the contact surfaces of the first and second contacts and thereby electrically disconnect the jumper cable and conductive jaw section when the handle sections are gripped.

13. An automotive battery terminal clamp for a battery jumper cable as claimed by claim 12 wherein the actuator means is further comprised of:

an second lever connected to the linkage for selectively operating the linkage to close the first and second contacts.

14. An automotive battery terminal clamp for a battery jumper cable as claimed by claim 12 wherein the actuator means is further comprised of:

a hand engagable first lever on the one handle section for operating the linkage to open the switch when the handle sections are gripped;

wherein the linkage is an over-center linkage connecting the first lever to the second contact of the switch, responsive to pivotal movement of the first lever for shifting to a first over-center position to separate the first and second contacts and thereby open the switch when the handle sections are gripped and for remaining in the first over-center position, holding the first and second contacts separated after the grip on the handle sections is released.

15. An automotive battery terminal clamp for a battery jumper cable as claimed by claim 14 wherein the actuator means is further comprised of:

a hand engagable second lever on the one handle section and connected to the over-center linkage for operating the over-center linkage to shift to a second over-center position to close the first and second contacts of the switch and for holding the contacts closed until the first lever is operated to shift the over-center linkage back to the first over-center position.

16. An automotive battery terminal clamp for a battery jumper cable as claimed by claim 15 wherein the first and second levers are integral.

17. An automotive battery terminal clamp for a battery jumper cable as claimed by claim 12 wherein the actuator means is comprised of:

a first lever section projecting over a portion of the one handle and pivotally mounted to the one handle section and an oppositely projecting second lever section, the first and second lever sections being integral and angularly oriented to one another such that when one lever section is pressed down toward the one hand section, the other lever section is pivoted upwardly from the one handle section;

a linkage connecting the first and second lever sections and one of the switch, contacts operable to separate the first and second contacts and thereby open the switch when the first lever section is pressed toward the one handle section and to move the contacts together into flush engagement and close the switch when the second lever section is pressed toward the one handle section.

18. An automotive battery terminal clamp as claimed by claim 17, wherein the linkage is an over-center linkage connecting the first and second lever sections to the second contact of the switch, responsive to pivotal movement of the first lever section to shift to a first over-center position and separate the first and second contacts to open the switch when the handle sections are gripped and to remain in the first over-center position, holding the contacts separated after the grip on the handles is released; and wherein the over-center linkage is also responsive to pivotal movement of the second lever section to shift to a second over-center position to (a) move the areal contact surfaces of the first and second contacts into flush engagement, with the areal contact surface of the first contact thereby closing the switch when the second lever section is pressed down toward the one handle section, and (b) hold the contact surfaces in flush engagement until the first lever section is pressed toward the one handle section.

* * * * *